US009751310B2

(12) United States Patent
Karita et al.

(10) Patent No.: US 9,751,310 B2
(45) Date of Patent: Sep. 5, 2017

(54) METHOD FOR MANUFACTURING LIQUID EJECTION HEAD

(71) Applicant: CANON KABUSHIKI KAISHA, Tokyo (JP)

(72) Inventors: Seiichiro Karita, Saitama (JP); Takatsuna Aoki, Yokohama (JP); Shingo Okushima, Kawasaki (JP); Noriyasu Nagai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/585,968

(22) Filed: Dec. 30, 2014

(65) Prior Publication Data

US 2015/0197089 A1 Jul. 16, 2015

(30) Foreign Application Priority Data

Jan. 14, 2014 (JP) ..... 2014-004316
Nov. 26, 2014 (JP) ..... 2014-239168

(51) Int. Cl.
*B41J 2/16* (2006.01)
*B41J 2/14* (2006.01)
*B41J 29/02* (2006.01)

(52) U.S. Cl.
CPC ..... *B41J 2/1623* (2013.01); *B41J 2/14024* (2013.01); *B41J 2/1433* (2013.01); *B41J 2/14088* (2013.01); *B41J 2/164* (2013.01); *B41J 2/1635* (2013.01); *B41J 29/02* (2013.01); *Y10T 29/49083* (2015.01); *Y10T 29/49126* (2015.01); *Y10T 29/49401* (2015.01); *Y10T 29/53191* (2015.01)

(58) Field of Classification Search
CPC .. B41J 2/14024; B41J 2/14088; B41J 2/1433; B41J 2/1623; B41J 2/1635; B41J 2/164; B41J 29/02; Y10T 29/49083; Y10T 29/49126; Y10T 29/49401; Y10T 29/53191
See application file for complete search history.

(56) References Cited

U.S. PATENT DOCUMENTS 5,748,213 A 5/1998 Karita et al.
5,826,333 A 10/1998 Iketani et al.
5,964,032 A 10/1999 Orikasa et al.
6,155,677 A 12/2000 Kitani et al.
(Continued)

FOREIGN PATENT DOCUMENTS

CN 101342813 A 1/2009
CN 101607474 A 12/2009
(Continued)

OTHER PUBLICATIONS

Office Action in Chinese Patent Application No. 201510017398.4, dated Jan. 7, 2016.
(Continued)

*Primary Examiner* — A. Dexter Tugbang
(74) *Attorney, Agent, or Firm* — Fitzpatrick, Cella, Harper & Scinto

(57) ABSTRACT

A method for manufacturing a liquid ejection head includes joining a support member to a print element substrate using another member to which the print element substrate is attached. The other member has a suction region to be held at the time of being attached to the support member.

6 Claims, 13 Drawing Sheets

(56) References Cited

U.S. PATENT DOCUMENTS

| | | | | |
|---|---|---|---|---|
| RE38,710 | E | 3/2005 | Goto et al. | |
| 6,988,316 | B1 * | 1/2006 | Kweon | B41J 2/1623 156/250 |
| 7,452,060 | B2 | 11/2008 | Nakamura et al. | |
| 7,571,970 | B2 | 8/2009 | Nystrom et al. | |
| 7,681,985 | B2 | 3/2010 | Nystrom et al. | |
| 8,141,988 | B2 | 3/2012 | Hirosawa | |
| 8,272,130 | B2 | 9/2012 | Miyazaki | |
| 2003/0227516 | A1 | 12/2003 | Yamaguchi et al. | |
| 2009/0046183 | A1 * | 2/2009 | Nishida | H01L 21/6835 348/294 |
| 2010/0214350 | A1 | 8/2010 | Oguchi | |

FOREIGN PATENT DOCUMENTS

| | | | | |
|---|---|---|---|---|
| CN | 101607477 | A | | 12/2009 |
| EP | 1 570 990 | A1 | | 9/2005 |
| JP | 2002-079676 | A | | 3/2002 |
| JP | 2011131463 | A | * | 7/2011 |

OTHER PUBLICATIONS

Office Action dated Sep. 6, 2016 in Chinese Patent Application No. 201510017398.4.

* cited by examiner

METHOD FOR MANUFACTURING LIQUID EJECTION HEAD

BACKGROUND OF THE INVENTION

Field of the Invention

The present invention relates to a liquid ejection head that ejects liquids, a liquid ejecting apparatus with the liquid ejection head, and a method for manufacturing the liquid ejection head.

Description of the Related Art

In general, in a liquid ejection head that is mounted on a liquid ejecting apparatus for ejecting liquids, print element substrates in each of which print elements, circuits for supplying electricity to the print elements, liquid flow passages, and the like are in advance incorporated are attached to a support member. In a case where an attachment position of the print element substrate is made to a position shifted from a predetermined position, accuracy of liquid landing position at ejection of liquids may be possibly affected because of the positional shift. Therefore high accuracy of position is required at the time of attaching the print element substrate to the support member.

Japanese Patent Laid-Open No. 2002-79676 discloses the attachment of a print element substrate on which alignment marks are placed to a support member. Upon attaching the print element substrate to the support member, the print element substrate is attached in a predetermined position while detecting a position and direction of the alignment mark by a CCD camera. In Japanese Patent Laid-Open No. 2002-79676, the print element substrate is suctioned by a finger, and the finger is moved to a predetermined position to move the print element substrate to the predetermined position.

However, the downsizing is required in an element substrate of a liquid ejection head that is mounted on a recent liquid ejecting apparatus. Since the element substrate tends to be downsized, a space in the element substrate for suctioning the element substrate by the finger is small at the time of suctioning and moving the element substrate by the finger. Therefore an area of the space for holding the print element substrate may be possibly insufficient within the print element substrate. In a case where the area of the region in the element substrate for the suctioning by the finger is insufficient, suction forces by the finger are not sufficient and there is a possibility that a positional shift occurs between the finger and the element substrate while the element substrate is held by the finger. Therefore the element substrate cannot be arranged with high accuracy of position, and accuracy of the liquid landing position of liquids ejected from the liquid ejection head may be possibly degraded.

SUMMARY OF THE INVENTION

The present invention is made in view of the above circumstances, and an object of the present invention is to provide a liquid ejection head with a member in which a space for suctioning and holding an element substrate is sufficiently ensured, a liquid ejecting apparatus with the liquid ejection head, and a method for manufacturing the liquid ejection head.

According to the present invention, a liquid ejection head comprises an element substrate including a pressure chamber that can reserve liquids therein, an energy generating element that applies energy to the liquid reserved in the pressure chamber, an ejection port that ejects the liquid to which the energy is provided by the energy generating element, and a supply port that supplies the liquid to the pressure chamber; a first member that includes a surface jointed to the element substrate; and a support member that includes a surface jointed to a back surface of the surface in the first member, wherein the surface of the first member has a holding region to be held at the time that the first member is jointed to the support member.

According to the present invention, a liquid ejecting apparatus comprises a liquid ejection head comprising an element substrate including a pressure chamber that can reserve liquids therein, an energy generating element that applies energy to the liquid reserved in the pressure chamber, an ejection port that ejects the liquid to which the energy is provided by the energy generating element, and a supply port that supplies the liquid to the pressure chamber; a first member that includes a surface jointed to the element substrate; and a support member that includes a surface jointed to a back surface of the surface in the first member, wherein the liquid is ejected on a medium from the ejection port, and the surface of the first member has a holding region to be held at the time that the first member is jointed to the support member.

According to the present invention, a method for manufacturing a liquid ejection head that includes an element substrate including a pressure chamber that can reserve liquids therein, an energy generating element that applies energy to the liquid reserved in the pressure chamber, an ejection port that ejects the liquid to which the energy is provided by the energy generating element, and a supply port that supplies the liquid to the pressure chamber; and a support member that supports the element substrate, includes an element substrate jointing step for jointing the element substrate to a first member; and a first member attaching step for causing the first member to which the element substrate is jointed to abut against the support member to attach the element substrate and the first member to the support member, in a state that a holding region in the first member is held.

According to the present invention, since the space for suctioning and holding the element substrate is sufficiently ensured, the element substrate can be arranged with high accuracy upon attaching the element substrate. Therefore accuracy of the liquid landing position at the ejection of the liquid can be improved.

Further features of the present invention will become apparent from the following description of exemplary embodiments (with reference to the attached drawings).

DESCRIPTION OF THE EMBODIMENTS

Hereinafter, embodiments in the present invention will be in detail explained with reference to the accompanying drawings.

First Embodiment

First, an explanation will be made of a liquid ejection head according to a first embodiment of the present invention.

Figure 1:
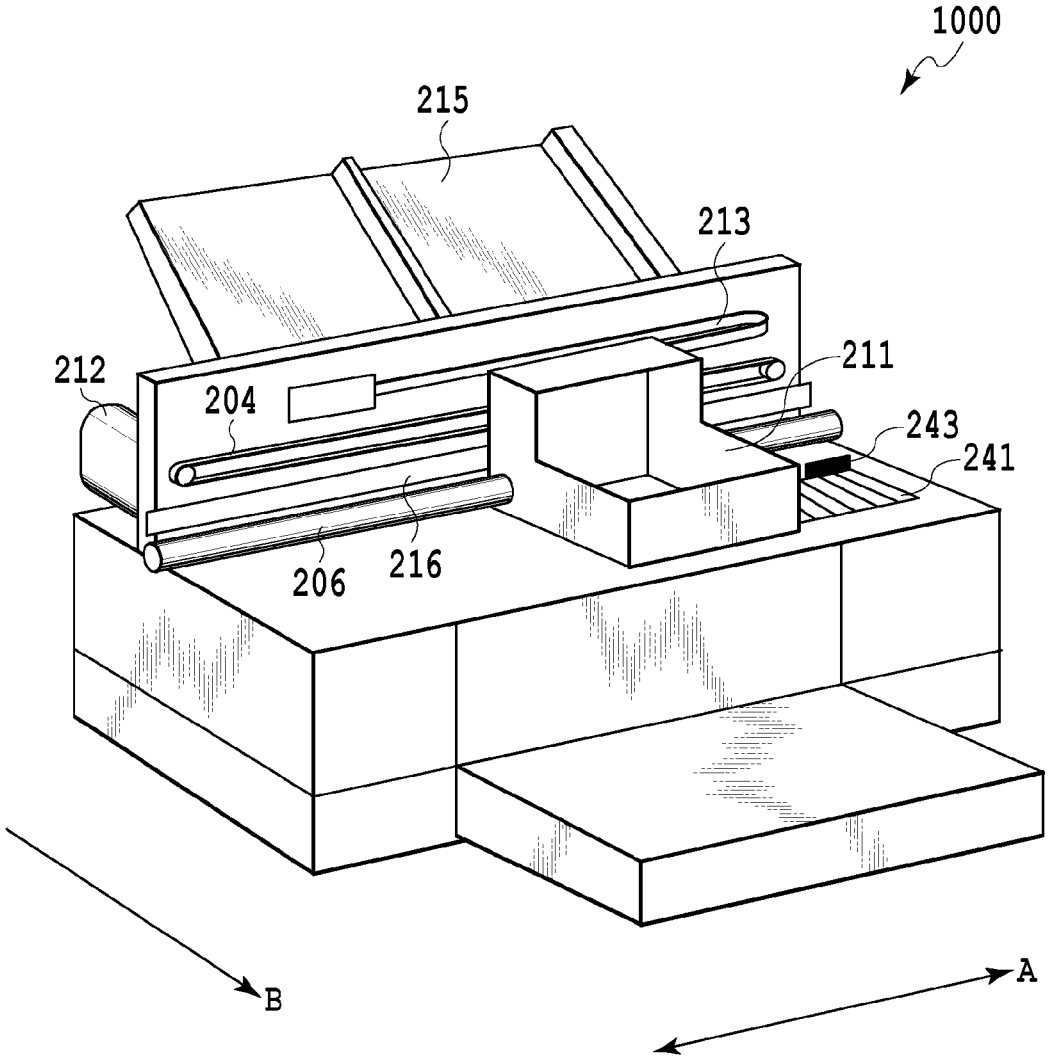
FIG. 1 is a perspective view showing an inkjet printing apparatus on which a print head according to a first embodiment of the present invention is mounted.

FIG. 1 is a perspective view showing an inkjet printing apparatus (liquid ejecting apparatus) 1000 on which print heads as liquid ejection heads according to the first embodiment of the present invention are mounted. The inkjet printing apparatus 1000 shown in FIG. 1 is provided with a carriage 211 in which print heads 1 are accommodated. In the inkjet printing apparatus 1000 in the present embodiment, the carriage 211 is guided along a guide shaft 206 to be movable in a main scan direction of arrows A. The guide shaft 206 is arranged to extend along the width direction of a print medium. Accordingly the inkjet head mounted in the carriage 211 performs a print while scanning in a direction crossing a conveying direction where the print medium is conveyed. In this way, the inkjet printing apparatus 1000 is what is called a serial scan type of inkjet printing apparatus that prints an image with the movement of the print head 1 in the main scan direction and the conveyance of the print medium in the sub scan direction.

The carriage 211 is penetrated and supported by the guide shaft 206 in such a manner as to be scanned in a direction perpendicular to the conveying direction of the print medium. A belt 204 is attached to the carriage 211, and a carriage motor 212 is attached to the belt 204. Therefore since a drive force by the carriage motor 212 is transmitted to the carriage 211 through the belt 204, the carriage 211 can move in the main scan direction while being guided by the guide shaft 206.

Further, a flexible cable 213 for transferring an electrical signal from a control unit to be described later to the inkjet head in an inkjet head unit is attached to the carriage 211 to be connected to the inkjet head unit. In the inkjet printing apparatus 1000, caps 241 and a wiper blade 243 used for executing recovery processing of the inkjet heads are arranged. In addition, the inkjet printing apparatus 1000 includes a feeding unit 215 that accommodates print mediums in a stack state, and an encoder sensor 216 that optically reads a position of the carriage 211.

The carriage 211 reciprocates in the main scan direction by a carriage motor and a drive force transmission mechanism such as a belt that transmits a drive force of the carriage motor. The print mediums are loaded on the feeding unit 215, and after that, are conveyed in the sub scan direction of an arrow B by a conveying roller. The inkjet printing apparatus 1000 moves the inkjet head in the main scan direction, and repeats a printing operation for ejecting ink and a conveying operation for conveying the print medium in the sub scan direction to sequentially print an image on the print medium.

Figure 2:
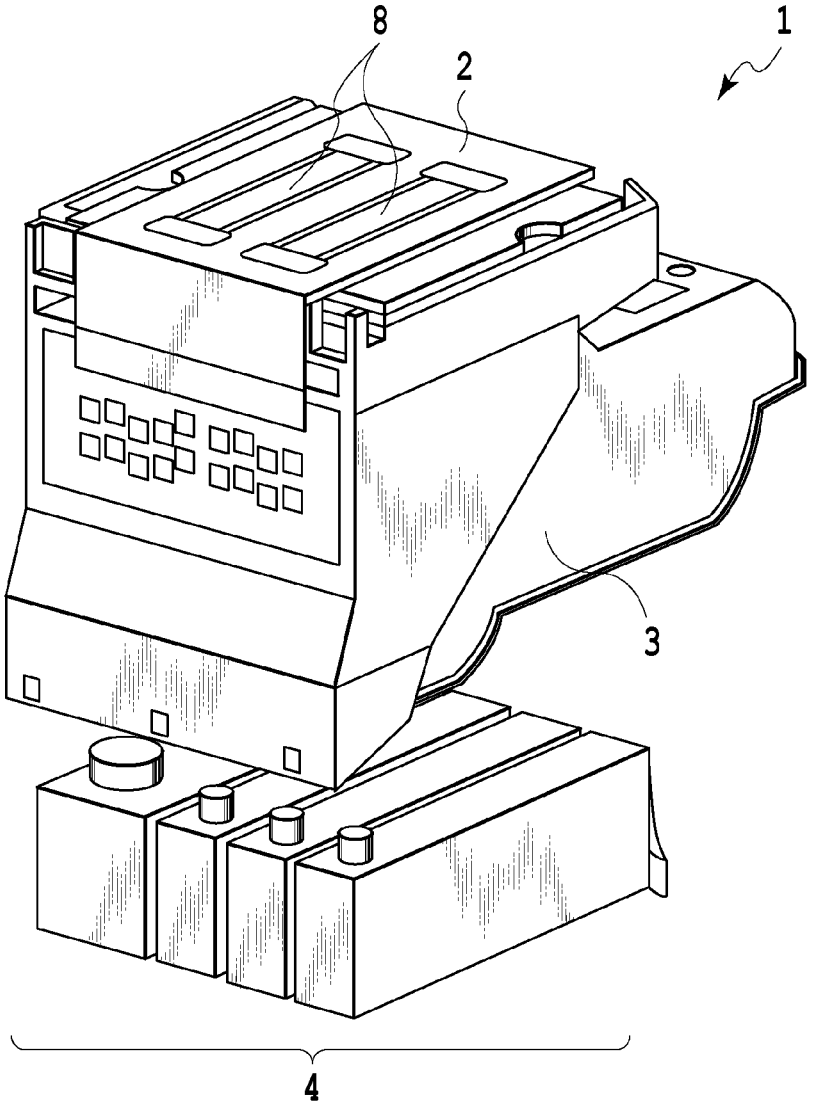
FIG. 2 is a perspective view showing the print head that is mounted on the inkjet printing apparatus in FIG. 1.

FIG. 2 shows a perspective view of the print head 1 that is mounted on the carriage 211 in the printing apparatus 1000. FIG. 2 shows the print head 1 arranged in a state where a surface opposed to the print medium of the print head 1 is directed above. At the time of mounting the print head 1 on the liquid ejecting apparatus 1000, the print head 1 is mounted on the carriage 211 in such a manner that a surface of the print head 1 on which ejection ports are formed opposes the print medium.

The print head 1 is provided with a tank holder 3 that accommodates a plurality of ink tanks 4 and a print element unit 2. The tank holder 3 is configured to be able to accommodate the plurality of ink tanks 4. The print element unit 2 is provided with print element substrates (element substrates) 8.

Figure 3A:
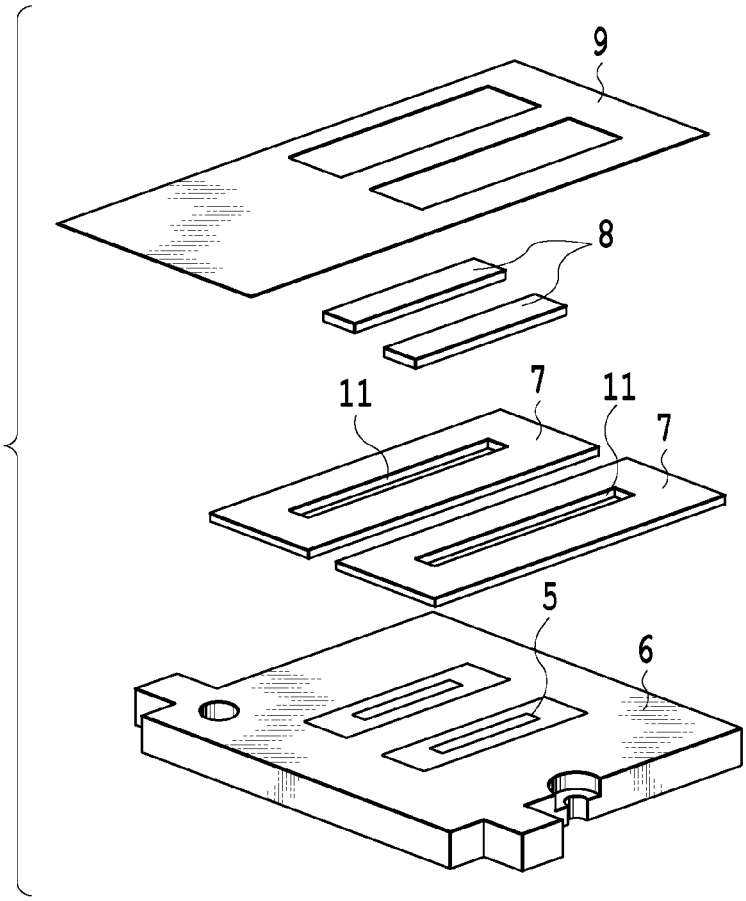
FIG. 3A is a perspective view showing the print head in FIG. 2 in a state of being exploded into the respective elements.
Figure 3B:
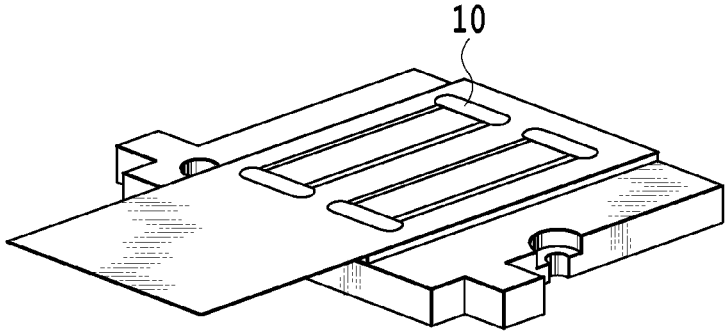
FIG. 3B is a perspective view showing the print head in FIG. 2 in a state where the respective elements are assembled.

FIG. 3A shows a perspective view of the print element unit 2 that is exploded into the respective elements for explaining the configuration of the print element unit 2. FIG. 3B shows a perspective view of the print element unit 2 formed by assembling the respective elements in FIG. 3A.

The print element unit 2 is, as shown in FIG. 3A, formed by attaching two first members 7 to a support member 6, attaching the print element substrate 8 to each of the two first members 7, and causing an electrical wiring plate 9 to adhere thereon. Ink supply ports 5 are formed in the support member 6. In addition, an ink supply port 11 is formed in the first member 7 to penetrate therethrough.

An electrical connection portion between an electrode (not shown) provided in the wiring of the electrical wiring plate 9 and an electrode (not shown) provided in the wiring of the print element substrate 8 is coated with a sealing agent 10. The sealing agent 10 protects the electrical connection portion between the electrical wiring plate 9 and the print element substrate 8.

Figure 4A:
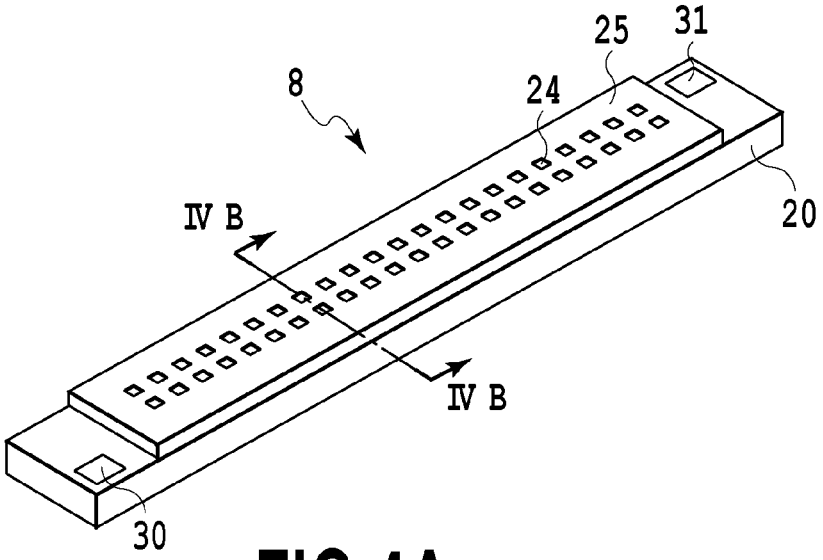
FIG. 4A is a perspective view showing the print element substrate used in the print head in FIGS. 3A, 3B.
Figure 4B:
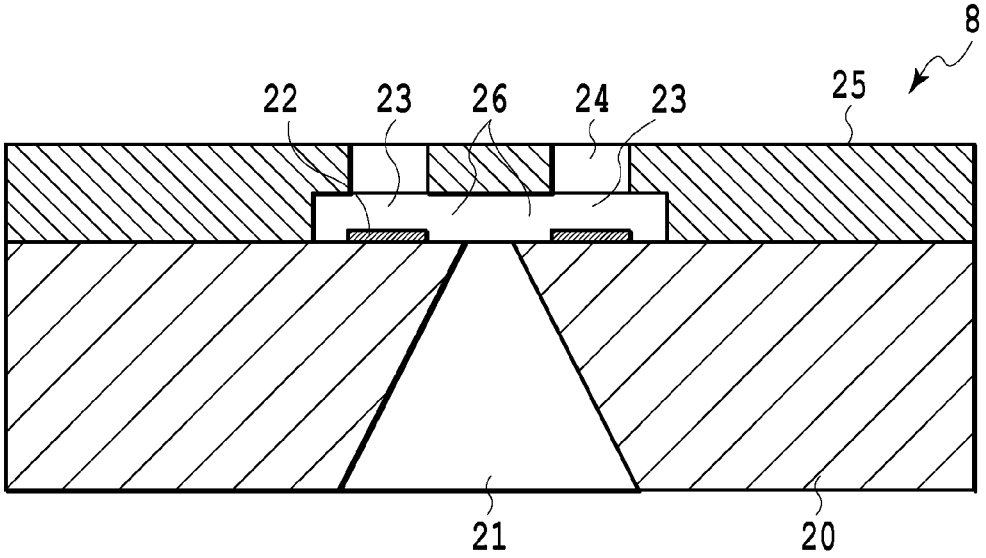
FIG. 4B is a cross section taken along line IVB-IVB in FIG. 4A.

Next, an explanation will be made of the print element substrate 8. FIG. 4A is a perspective view showing the print element substrate 8, and FIG. 4B is a cross section showing the print element substrate 8, taken along line IVB-IVB in FIG. 4A. The print element substrate 8 is formed by attaching a flow passage forming member 25 to a silicon substrate 20. The flow passage forming member 25, which is therein provided with a plurality of ink flow passages and a plurality of ejection ports 24 in accordance with electrothermal transducing elements, is formed on a front face side in the print element substrate 8 by a resin or the like.

Pressure chambers 23 are formed between the silicon substrate 20 and the flow passage forming member 25 in the print element substrate 8. The pressure chamber 23 is formed to be able to reserve or store ink as liquids therein, and ink that will be ejected from the print head 1 is once reserved inside the pressure chamber 23. Ejection ports 24 that are communicated with the pressure chambers 23 to eject the ink reserved in the pressure chambers 23 are formed in the flow passage forming member 25. In addition, the electrothermal transducing elements 22 are formed inside the pressure chambers 23 as elements applying energy to the ink reserved in the pressure chambers 23 for ejecting the ink from the ejection ports 24. In the present embodiment, an example that the electrothermal transducing element 22 as the energy generating element is applied is shown. However, the present invention is not limited to this embodiment; for example, a piezo element and the like can be applied.

An ink supply port 21 for supplying ink to a plurality of ink flow passages is formed in the silicon substrate 20 to penetrate through the silicon substrate 20. Flow passages 26 are formed between the ink supply port 21 and the pressure chambers 23 for supplying ink to the respective pressure chambers 23 from the ink supply port 21.

The ejection port 24 for ejecting ink is formed in a position of the flow passage forming member 25 corresponding to the electrothermal transducing element 22. The ink to which thermal energy is given by a drive of the electrothermal transducing element 22 causes film boiling inside the pressure chamber 23, thereby ejecting the ink toward the print medium from the ejection port 24. In the present embodiment, the electrothermal transducing element 22 is used as an energy generating element that generates energy for ejecting ink in the print element substrate 8. Supplying power to each of the electrothermal transducing elements 22 causes film boiling in the ink reserved in the pressure chamber 23. In addition, electrical wiring is installed in the print element substrate 8 for transmitting current to the electrothermal transducing elements 22.

It should be noted that the print head 1 in the present embodiment is configured as a system in which the electrothermal transducing element causes the film boiling in the ink to generate bubbles and eject ink droplets, but the present invention is not limited thereto, and a print head in the form of deforming a piezo element to eject liquids in a print head may be applied to a printing apparatus or the other type of print head may be applied to the printing apparatus in the present invention.

Index portions 30, 31 are formed in the ends of the print element substrate 8 to be used for position adjustment upon bonding the print element substrate 8 on the support member 6. In the present embodiment, the index portions 30, 31 are provided in both the ends of the print element substrate 8. The index portions 30, 31 are used for adjustment of a position of the print element substrate 8 upon attaching the print element substrate 8 on the support member 6. The adjustment of the position of the print element substrate 8 upon attaching the print element substrate 8 to the support member 6 will be described later.

Figure 5B:
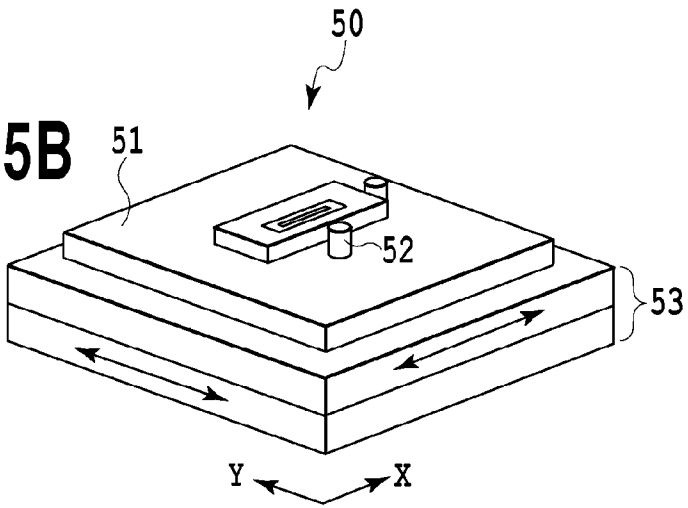
FIG. 5B is a perspective view showing a support member fixing unit.
Figure 5D:
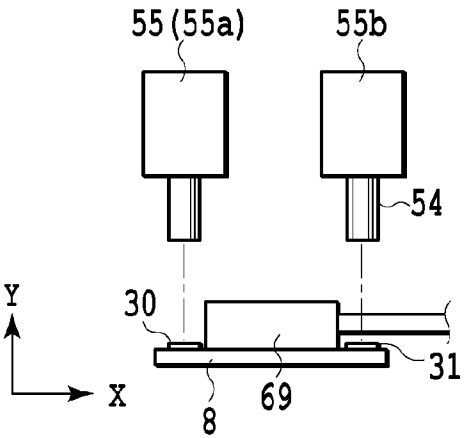
FIG. 5D is a front view showing cameras.
Figure 5A:
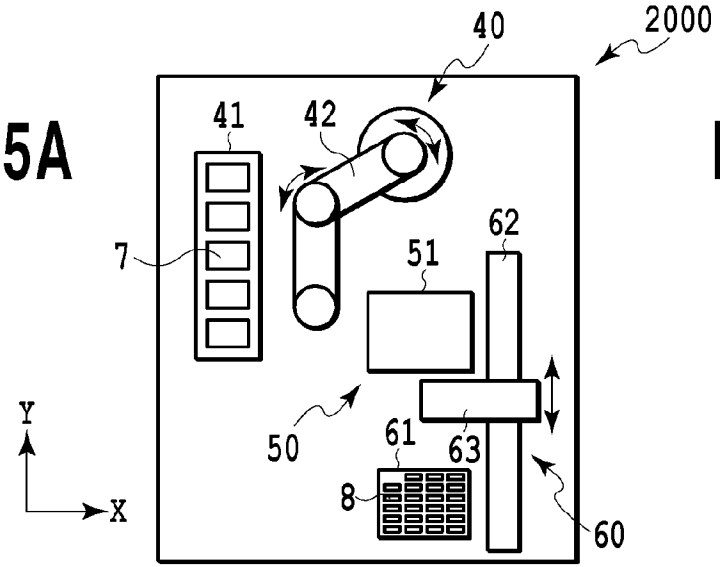
FIG. 5A is a plan view showing a mounter used in attachment between the print element substrate in FIGS. 3A, 3B and a first member.

Next, an explanation will be made of an apparatus (hereinafter, also referred to as "mounter") 2000 for attaching the print element substrates (hereinafter, referred to as "chip") 8 to the first members 7 with reference to FIGS. 5A to 5D. FIG. 5A is a plan view showing a schematic configuration of the mounter 2000. The mounter 2000 includes a first member conveying unit 40, a support member fixing unit 50 and a substrate conveying unit 60.

The first member conveying unit 40 includes a first member tray 41 and a first member conveying robot 42. The plurality of first members 7 prior to attaching the print element substrates 8 thereto are arranged in the first member tray 41. In the present embodiment, in a state where the first member 7 is placed on the first member tray 41, an adhesive is applied on a part of the first member 7 for attachment to the print element substrate 8. The first member conveying robot 42 has a link mechanism, and is configured such that a front end part is movable between a position above the first member tray 41 and the support member fixing unit 50. The first member conveying robot 42 can hold a member arranged on the first member tray 41 by the front end part.

The support member fixing unit 50 is provided with a support member fixing tool 51. The support member fixing tool 51 places a member on the surface as a stage. The support member fixing tool 51 is provided with pins 52 arranged thereon, and the pins 52 can be used to position the member on the stage. In addition, the support member fixing tool 51 is provided with XY stages 53 that can move the member on the support member fixing tool 51 along arrow directions shown in FIG. 5B. The position of the member on the support member fixing tool 51 can be adjusted by moving the XY stage 53.

In addition, cameras 55 are arranged in positions corresponding to the support member fixing tool 51. The cameras 55 can image the member arranged on the support member fixing tool 51 as shown in FIG. 5D. In the present embodiment, the two cameras 55 composed of a camera 55*a* and a camera 55*b* are arranged in positions corresponding to the support member fixing tool 51 and above it to correspond to the two index portions 30, 31 formed on the print element substrate 8. The installation positions of the cameras 55*a*, 55*b* are accurately adjusted such that the reference index portions 30, 31 each are positioned in the center of each of both the cameras 55*a*, 55*b*.

The substrate conveying unit 60 is provided with a substrate tray 61 and a substrate conveying robot 62. The plurality of print element substrates 8 prior to being attached to the first members 7 on the support member fixing tool 51 line up on the substrate tray 61. The substrate conveying robot 62 is provided with a movable table 63. The movable table 63 is configured to be able to move by sliding along a rail.

Figure 5C:
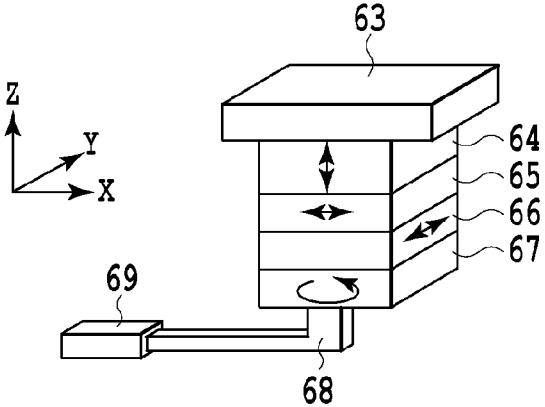
FIG. 5C is a perspective view showing a substrate conveying unit.

As shown in FIG. 5C, the movable table 63 is provided with a Z stage 64, an X stage 65, a Y stage 66 and a θz stage 67 in that order from above. Further, an arm 68 is attached to the θz stage 67, and a finger (suction unit) 69 is attached to a front end of the arm 68. The finger 69 can produce a negative pressure. When the finger 69 produces the negative pressure and the finger 69 abuts against a target member, the finger 69 can suction and hold the member. The attachment of the print element substrate 8 to the first member 7 is performed by such a mounter 2000.

Upon attaching the print element substrate 8 to the first member 7, first, the first members 7 lining up on the first member tray 41 are placed on the support member fixing tool 51 by the first member conveying robot 42. In the present embodiment, the first member conveying robot 42 picks up the first members 7 one by one, then moves the first member 7 in a state of being held by the first member conveying robot 42, and places the first member 7 on the support member fixing tool 51. At this time, as shown in FIG. 5B, the first member 7 strikes on and abuts against the pins 52 on the support member fixing tool 51. The position of the first member 7 is adjusted by moving the support member fixing tool 51 with the XY stage 53 to arrange the first member 7 in a predetermined position.

Next, the print element substrate 8 is jointed to the first member 7 on the support member fixing tool 51 (element substrate jointing step). For attaching the print element substrate 8 to the first member 7, the substrate conveying robot 62 is driven to move the movable table 63 and move the finger 69 until the finger 69 is arranged in a position corresponding to the substrate tray 61. When the finger 69 reaches the position corresponding to the print element substrate 8 on the substrate tray 61, the finger 69 suctions air to suction and hold the print element substrates 8 one by one. When the finger 69 holds the target print element substrate 8, the movable table 63 is moved to move the print element substrate 8 to the position corresponding to the first member 7 on the support member fixing tool 51. When the print element substrate 8 is arranged to the position corresponding to the first member 7, the position adjustment of the print element substrate 8 relative to the first member 7 is herein performed.

When the position adjustment between the first member 7 and the print element substrate 8 is performed, the Z stage 64 is herein driven to lower down the print element substrate 8, thus causing the print element substrate 8 to abut against the first member 7 for attachment. When the attachment between the first member 7 and the print element substrate 8 is performed, a joint body 105 produced as a result of the attachment between the first member 7 and the print element substrate 8 is discharged. In the present embodiment, the joint body 105 is discharged by the first member conveying robot 42.

Figure 6:
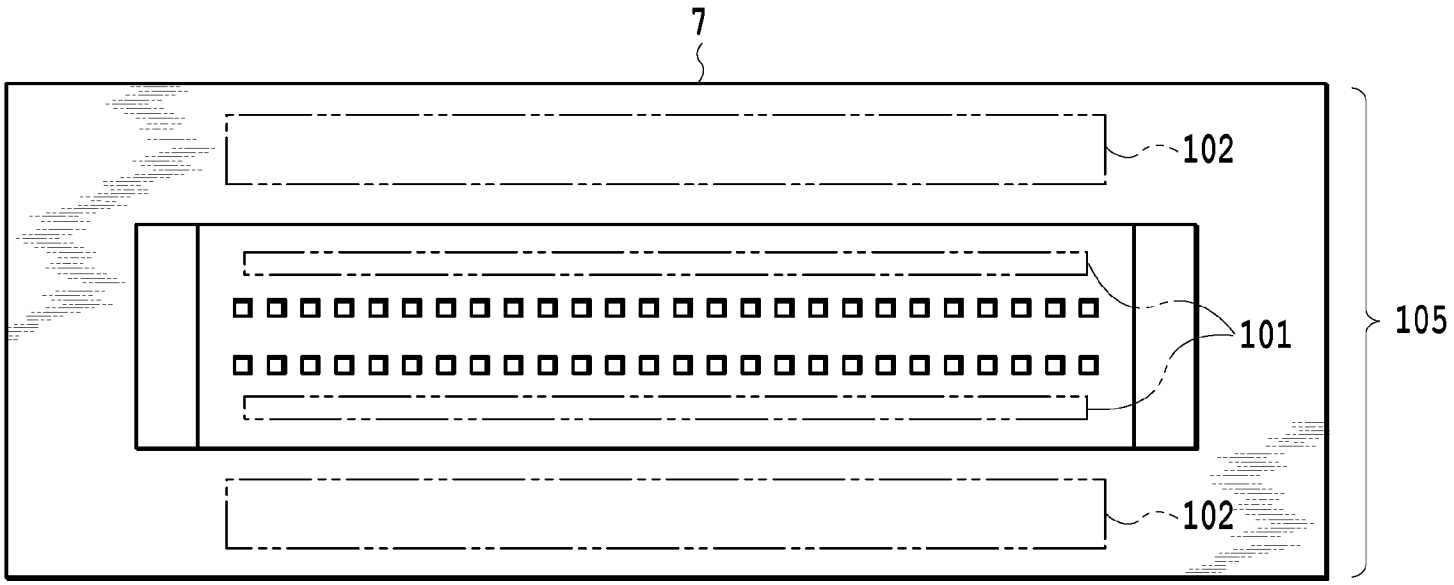
FIG. 6 is a plan view showing a joint body to which the print element substrate and the first member are attached.

FIG. 6 is a plan view showing the joint body 105 in which the first member 7 and the print element substrate 8 are attached. The print element substrate 8 is attached to the first member 7 formed to be longer than the print element substrate 8 in an array direction of an ejection port array and in a direction crossing the array direction. Accordingly suction regions (holding regions) 102 for being suctioned by the finger 69 upon attachment to the support member 6 are formed outside of the print element substrate 8.

Figure 7:
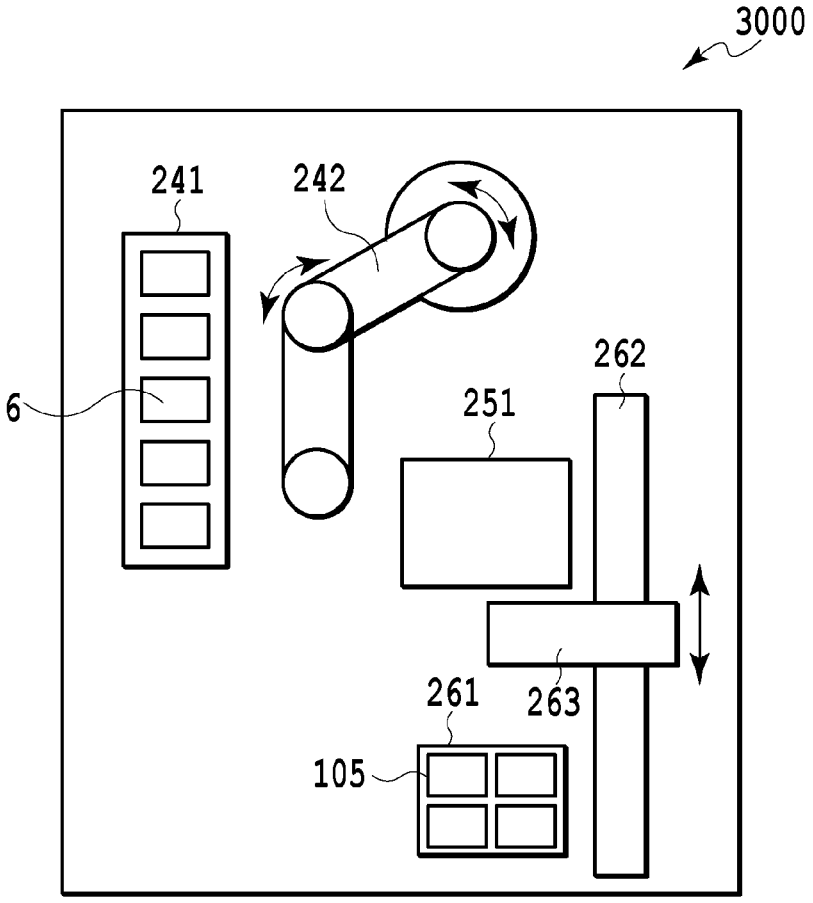
FIG. 7 is a plan view showing a mounter used in attachment between the joint body formed by the attachment between the print element substrate in FIGS. 3A, 3B and the first member, and a support member.

Next, the joint body 105 in which the first member 7 and the print element substrate 8 are attached is attached to the support member 6 (first member attaching step). The attachment of the joint body 105 to the support member 6 is performed in the same way as the attachment of the print element substrate 8 to the first member 7. The attachment of the joint body 105 to the support member 6 is performed by a mounter 3000. FIG. 7 is a plan view showing the mounter 3000 that performs the attachment of the joint body 105 to the support member 6. The configuration of the mounter 3000 that performs the attachment of the joint body 105 to the support member 6 is similar to that of the mounter 2000 that performs that attachment of the print element substrate 8 to the first member 7.

For attaching the joint body 105 to the support member 6, first, the support members 6 lining up on a support member tray 241 are placed on a support member fixing tool 251 by a support member conveying robot 242. At this time, the support member conveying robot 242 picks up the support member 6, and then moves the support member 6 to the support member fixing tool 251 in a state of being held by the support member conveying robot 242. Next, a substrate conveying robot 262 is driven to move a movable table 263 and move the finger until the finger attached to the front end of the movable table 263 is arranged in a position corresponding to a substrate tray 261. When the finger reaches the position corresponding to the joint body 105 on the substrate tray 261, the finger suctions the joint body 105. The finger moves the movable table 263 in a state of suctioning and holding the target joint body 105, and moves the joint body 105 to a position corresponding to the support member 6 on the support member fixing tool 251. The position adjustment between the support member 6 and the joint body 105 is herein performed, and the joint body 105 abuts against the support member 6 for attachment.

In addition, alignment marks for recognizing a position of the print element substrate 8 are formed on the print element substrate 8. For performing the position adjustment at attachment of the joint body 105 to the support member 6, the position adjustment is performed while detecting the positions of the alignment marks 30, 31 formed on the print element substrate 8 by the cameras 55*a*, 55*b*. The attachment of the joint body 105 to the support member 6 requires higher accuracy than the attachment of the print element substrate 8 to the first member 7. The print element substrate 8 is arranged in a final attachment position by the attachment of the joint body 105 to the support member 6.

In this way, in the present embodiment, for jointing the print element substrate 8 to the support member 6, first, the print element substrate 8 is attached to the first member 7 to form the joint body 105. Then, the joint body 105 is attached to the support member 6 to perform the attachment between the print element substrate 8 and the support member 6. At this time, the joint body 105 is suctioned by the finger 69 to be attached to the support member 6. As a result, since the suction by the finger 69 is performed in the relatively wide suction regions 102 in the joint body 105, the joint body 105 can be suctioned to the finger 69 by the relatively strong suction. Since the joint body 105 can be suctioned by the strong suction force, it is possible to suppress the positional shift from being generated between the finger 69 and the joint body 105 while the finger 69 suctions and holds the joint body 105. Therefore the joint body 105 can be accurately attached in the predetermined position of the support member 6 with high accuracy of position.

In addition, since the joint body 105 can be suctioned to the finger 69 by the high suction force, the finger 69 makes the joint body 105 land on the adhesive applied on the support member 6 in a state where the joint body 105 is suctioned by the finger 69, making it possible to correct the position of the joint body 105 herein. Since the suction force of the finger 69 to the joint body 105 is relatively large, even if the joint body 105 is installed on the adhesive applied on the support member 6, the force of suctioning and holding the joint body 105 by the finger 69 exceeds the force of holding the joint body 105 by the adhesive. Therefore it is possible to move the joint body 105 on the adhesive applied on the support member 6 without generation of the positional shift between the finger 69 and the joint body 105. The joint body 105 is once arranged on the adhesive applied on the support member 6, and herein minute correction of the attachment position of the joint body 105 to the support member 6 can be made. Therefore the minute adjustment of the attachment position can be easily performed. As a result, accuracy of the position of the joint body 105 at the time of attaching it to the support member 6 can be further improved. In this way, according to the present embodiment, the joint body 105 is once caused to abut against the support member 6 on which the adhesive is applied, and the minute adjustment of the position of the print element substrate 8 can be made in a state where the joint body 105 is in contact with the support member 6 through the adhesive in a step prior to solidification of the adhesive.

In addition, upon attaching the joint body 105 as a relatively large member to the support member 6, the joint region between the joint body 105 and the support member 6 can be widely provided. Therefore the joint body 105 can be stably attached to the support member 6, and as a result, the print element substrate 8 can be stably attached to the support member 6.

Figure 8:
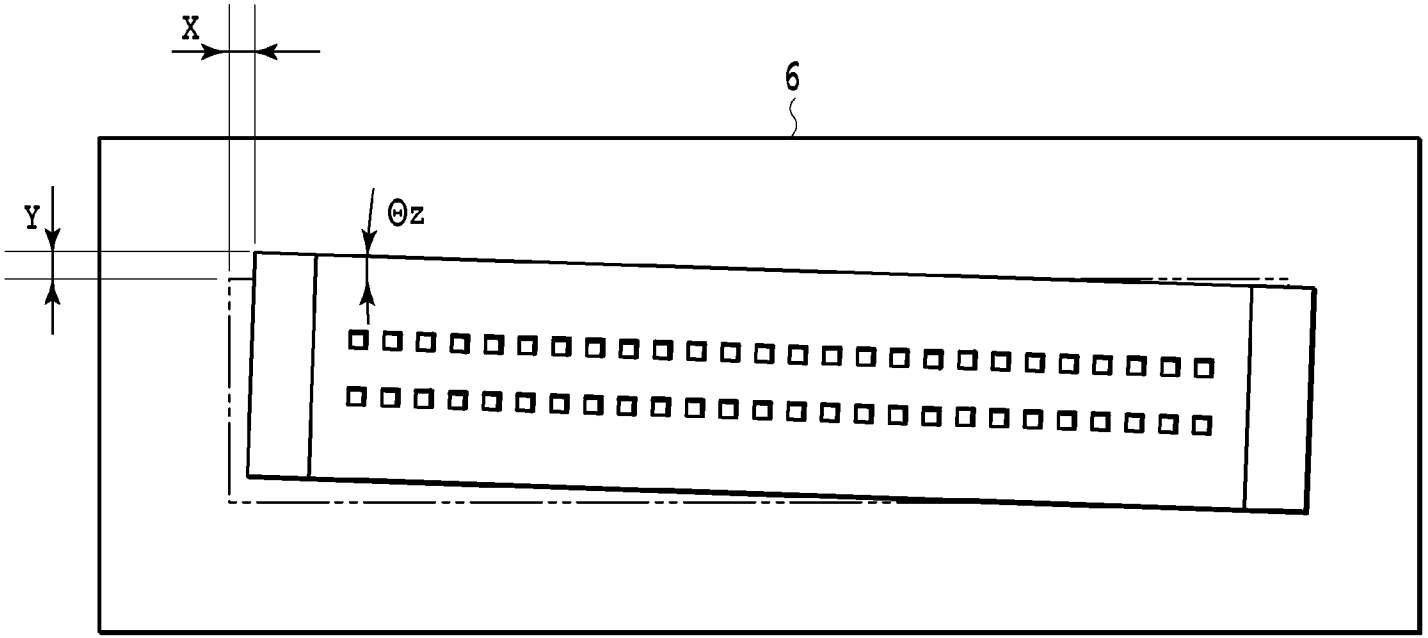
FIG. 8 is a plan view showing a print element substrate and a support member in a case where the print element substrate is directly attached to the support member, as a comparative example.

An explanation will be made of a case where the print element substrate 8 is directly attached to the support member 6, as a comparative example. FIG. 8 is a plan view showing the peripheral part of the print element substrate 8 in a case of attaching the print element substrate 8 to the support member 6.

In a case of directly attaching the print element substrate 8 to the support member 6, the print element substrate 8 is relatively narrow, and an area of the suctioning region of the print element substrate 8 at the time of suctioning the print element substrate 8 by the finger 69 is relatively narrow. Therefore the suction force for suctioning the print element substrate 8 by the finger 69 may be possibly insufficient. Since the suction force of suctioning the print element substrate 8 is relatively small, the positional shift between the finger 69 and the print element substrate 8 may be possibly generated at the time of arranging the print element substrate 8 to the support member 6.

In addition, since the suction force of the finger 69 to the print element substrate 8 is small, when the print element substrate 8 is installed on the support member 6 for arranging the print element substrate 8, it is difficult to correct the position of the print element substrate 8 on the adhesive in the support member 6. Since the suction force of suctioning the print element substrate 8 is relatively small, even if the print element substrate 8 will be moved relative to the support member 6 in a state where the print element substrate 8 is installed on the adhesive applied on the support member 6, there is a possibility that the finger 69 cannot hold the print element substrate 8. When the force with which the finger 69 suctions and holds the print element substrate 8 is small, there is a possibility that the suctioning and holding force becomes lower than the force of holding the print element substrate 8 by the adhesive, and the positional shift is generated between the finger 69 and the print element substrate 8 at the time of trying to move the print element substrate 8. Accordingly at the time of arranging the print element substrate 8 on the support member 6, there is a possibility that the position of the print element substrate 8 is shifted, and the print element substrate 8 cannot be arranged with high accuracy.

On the other hand, according to the present embodiment, the print element substrate 8 is attached to the first member 7 to form the joint body 105 and the joint body 105 is attached to the support member 6. Therefore the area of the suction part of the joint body 105 by the finger 69 can be broadly provided. Accordingly since the strong suction force by the finger 69 can be ensured, it is possible to move the joint body 105 in a state where the joint body 105 abuts against the support member 6 through the adhesive. Accordingly the minute correction of the position of the print element substrate 8 can be made in a state where the joint body 105 is attached to the support member 6 by the adhesive. As a result, the attachment of the print element substrate 8 to the support member 6 can be performed while ensuring the high accuracy of position of the print element substrate 8 relative to the support member 6.

In the present embodiment, by making the correction of the attachment positions regarding X, Y, and θz of the print element substrate 8 while detecting the alignment marks 30, 31 formed on the print element substrate 8, the attachment of the print element substrate 8 can be performed such that the accuracy of the attachment position is within predetermined accuracy. Particularly in the present embodiment, since the position of the joint body 105 can be minutely adjusted in a state where the joint body 105 is attached to the support member 6 through the adhesive, a final attachment of the print element substrate 8 to the support member 6 can be performed with high accuracy of 1 μm or less.

In addition, when another joint body 105 is likewise attached to the support member 6, the two joint bodies 105 result in being attached to the support members 6 as shown in FIGS. 3A, 3B. Therefore each of the print element substrates 8 can be attached with high accuracy in relation to a reference of the support member 6 (mount reference relative to the printing apparatus 1000). The attachment between the support member 6 and the joint body 105 is performed, and after that, the electrical wiring plate 9 is bonded thereon to manufacture the print element unit 2.

It should be noted that in the present embodiment, in the attachment between the print element substrate 8 and the first member 7, the adhesive is in advance applied on the first member 7, and the print element substrate 8 is attached in the region of the first member 7 on which the adhesive is applied. In addition, in the attachment between the joint body 105 and the support member 6, the adhesive is in advance applied on the support member 6, and the joint body 105 is attached in the region of the support member 6 on which the adhesive is applied. However, the present invention is not limited thereto, and the attachment between the print element substrate 8 and the first member 7 may be performed such that the adhesive is in advance applied on the print element substrate 8, and the adhesive-applied print element substrate 8 is attached to the first member 7. In addition, the attachment between the joint body 105 and the support member 6 may be performed such that the adhesive is in advance applied on the joint body 105, and the adhesive-applied joint body 105 is attached to the support member 6. Further, the adhesive may be in advance applied on both of the print element substrate 8 and the first member 7, or likewise the adhesive may be in advance applied on both of the joint body 105 and the support member 6. Since the suction region 102 is sufficiently ensured on the joint body 105 also in that case, the joint body 105 can be certainly held by the finger 69. Therefore after applying the adhesive thereto, the joint body 105 can be moved relative to the support member 6 to perform the minute adjustment of the joint body 105 relative to the support member 6.

Further, in the present embodiment, in the attachment between the print element substrate 8 and the first member 7, the first members 7 on which the adhesive is in advance applied are arranged in array in the first member tray 41. In addition, in the attachment between the joint body 105 and the support member 6, the joint bodies 105 on which the adhesive is in advance applied are arranged in array in the support member tray 241. However, the present invention is not limited thereto, and the adhesive may be applied in the mounter 2000 or 3000 when the first member 7 or the joint body 105 is arranged in the mounter 2000 or 3000.

Second Embodiment

Next, an explanation will be made of a print head 2001 as a liquid ejection head according to a second embodiment of the present invention. It should be noted that components identical to those in the first embodiment are referred to as identical signs to omit the explanation, and only different components will be explained.

Figure 9A:
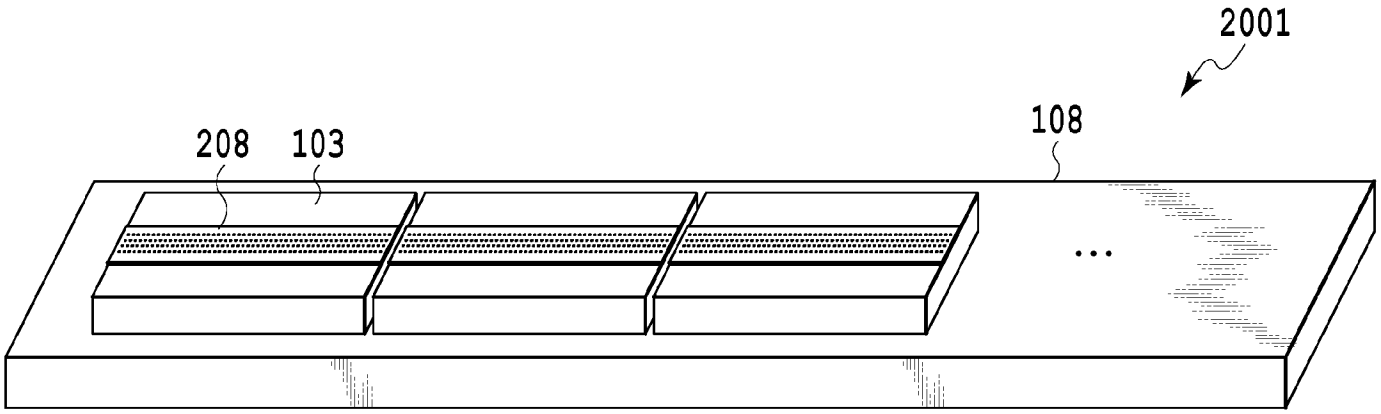
FIG. 9A is a perspective view showing a print head according to a second embodiment of the present invention.
Figure 9B:
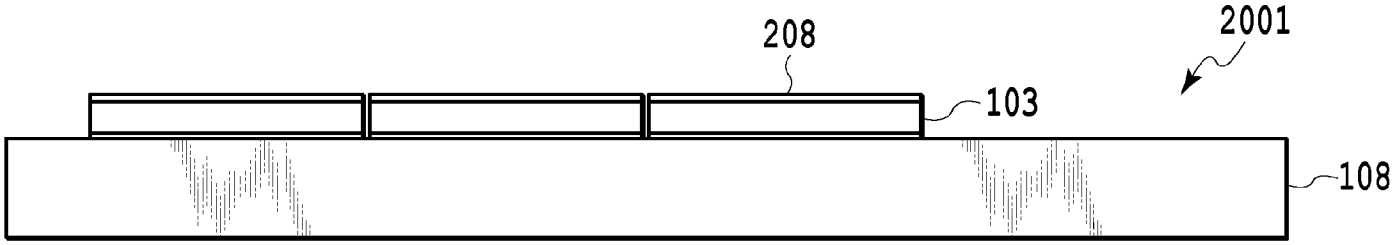
FIG. 9B is a side view showing the print head according to the second embodiment.

FIG. 9A is a perspective view showing the print head 2001 according to the second embodiment, and FIG. 9B is a side view showing the print head 2001 according to the second embodiment. As shown in FIGS. 9A, 9B, the second embodiment relates to a line head type applied to a full line type of print apparatus in which a plurality of print element substrates line up in one line, and the print head 2001 extends over an entire region of the width direction of the print medium.

Figure 10:
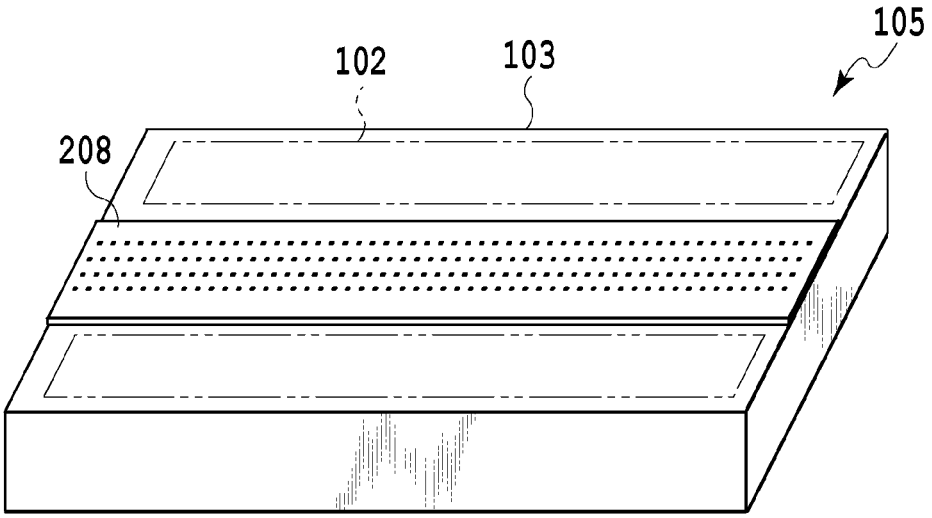
FIG. 10 is a perspective view showing one joint body among a plurality of joint bodies used in the print head in FIGS. 9A, 9B.

FIG. 10 is a perspective view showing one print element substrate 208 and one first member 103 among a plurality of print element substrates and a plurality of first members in the print head 2001 shown in FIGS. 9A, 9B. As shown in FIG. 10, the print element substrate 208 and the first member 103 are attached to each other to form the joint body 105. In the print element substrate 208, a plurality of ejection ports are arranged along one direction of the print element substrate 208 to form an ejection port array. In the present embodiment, the print element substrate 208 and the first member 103 are formed such that a length of the first member 103 along a direction crossing an array direction of the ejection port array is longer than a length of the print element substrate 208 along a direction crossing the array direction of the ejection port array.

As shown in FIGS. 9A, 9B, in the print head 2001 of the second embodiment, a plurality of the first members 103 to each of which the print element substrate 208 is attached are arranged on the support member 108. A plurality of the print element substrates 208 are arranged in the support member 108 such that the plurality of print element substrates 208 are connected along the same direction with the direction where the ejection port arrays are arranged. In addition, the plurality of print element substrates 208 are arranged such that the ejection port arrays formed in each of the plurality of print element substrates 208 are arranged in the same straight line.

As shown in FIG. 10, in the print head 2001 of the second embodiment, the plurality of ejection port arrays are arranged in array in one print element substrate 208. Particularly in the present embodiment, four ejection port arrays are formed in one print element substrate.

In addition, suction regions 102 for suction by the finger 69 are provided in the regions in the first member 103 outside of the print element substrate 208 along the direction crossing the direction where the ejection port array is arranged in array. In addition, alignment marks (not shown) are formed on each of the print element substrates 208.

At the time of attaching the print element substrate to the first member, there is a possibility that the positional shift is generated between the print element substrate and the first member. The attachment is performed without correcting the positional shift at the attaching between the print element substrate and the first member.

Figure 11:
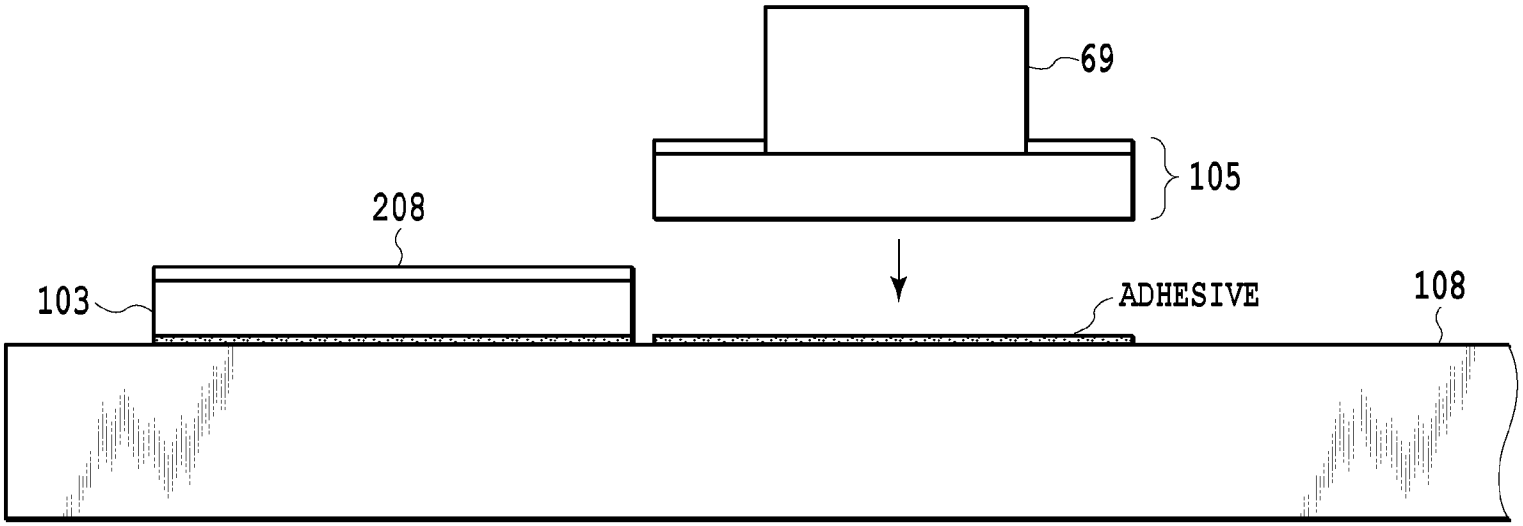
FIG. 11 is an explanatory diagram explaining a manufacturing process of the print head in FIGS. 9A, 9B.

Next, the joint body 105 in which the print element substrate and the first member are jointed is attached to the support member 108. For attaching the joint body 105 to the support member 108, first, a part of the support member 108 as a reference of X, Y, and Z directions abuts against the tool, and this joint body 105 is attached to the support member 108 fixed on a stage. At this moment, as shown in FIG. 11, the suction regions 102 in the joint body 105 projecting outside of the print element substrate 208 are suctioned by the finger 69, and the finger 69 is moved to cause the joint body 105 to abut against the support member 108 for joint. At this time, the position of the joint body 105 is corrected in a state where the joint body 105 is installed in the support member 108 through the adhesive, thus making it possible to perform the minute adjustment of the position of the print element substrate 208.

The alignment of the joint body 105 is performed such that the alignment mark formed in the print element substrate 208 is detected by the camera, and the position of the joint body 105 is minutely adjusted while confirming the position of the alignment mark. When the joint body 105 is jointed to the support member 108, the position adjustment of the support member 108 and the joint body 105 is performed respectively in the X, Y and θz directions in a state where the support member 108 and the joint body 105 are in contact with each other through the adhesive. After the joint body 105 is arranged in a predetermined position with high accuracy, the adhesive is solidified. Warpage and roll of the joint body 105 in the Z direction, variations in dimension of the first member and the like relative to the support member 108 can be absorbed by the thickness of the adhesive between the joint body 105 and the support member 108. Accuracy of the position of the joint body 105 in the Z direction is determined by accuracy of the position at the attaching of the joint body 105 by the mounter.

Third Embodiment

Next, an explanation will be made of a print head as a liquid ejection head according to a third embodiment of the present invention. It should be noted that components identical to those in the first embodiment and second embodiment are referred to as identical signs to omit the explanation, and only different components will be explained.

The third embodiment differs from the first embodiment and the second embodiment in a point where a plurality of joint bodies 105 attached to a tool are together attached to the support member 108.

FIGS. 12A to 12D are explanatory diagrams explaining a manufacturing process of the print head according to the third embodiment. The print head according to the third embodiment, as similar to the second embodiment, relates to a line head type applied to a full line type of printing apparatus in which the print head extends over an entire region of the width direction of the print medium.

Figure 12A:
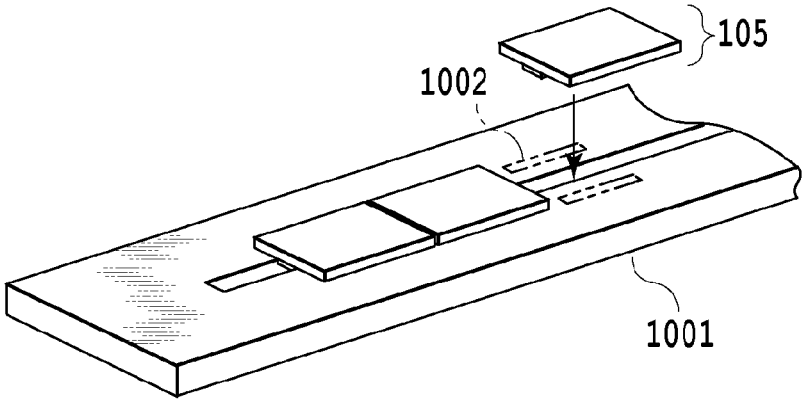
FIGS. 12A to 12D are explanatory diagrams explaining a manufacturing process of a print head according to a third embodiment of the present invention.

The joint body 105 in which the print element substrate 208 and the first member 103 are jointed is manufactured in the method similar to that of the second embodiment. Next, the plurality of joint bodies 105 are, as shown in FIG. 12A, attached to a tool 1001 in a removable state. The tool 1001 is provided with suction portions 1002 that are able to suction air. The joint body 105 is suctioned by suctioning air by the suction portions 1002, thus making it possible to attach the joint body 105 to the tool 1001.

The alignment between the print element substrate 208 and the first member 103 in the joint body 105 is, as similar to the second embodiment, performed while detecting the alignment mark provided on the print element substrate 208 by the camera 55. In the alignment between the print element substrate 208 and the first member 103 in the joint body 105, the position correction of the print element substrate 208 in the X, Y and θz is made, and the attachment is accurately performed. In this way, the joint body 105 in which the print element substrate 208 and the first member 103 are attached is suctioned and fixed on the tool 1001 sequentially.

Figure 12B:
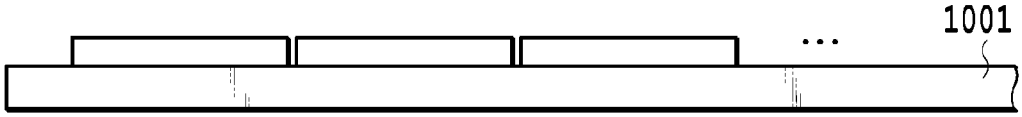
Figure 12C:
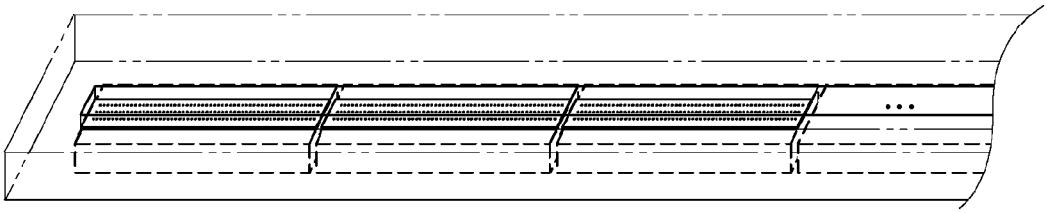

FIG. 12B is a side view showing the joint bodies 105 and the tool 1001 in a state where the joint bodies 105 are attached to the tool 1001. FIG. 12C is a perspective view showing the joint bodies 105 and the tool 1001 in a state where the joint bodies 105 are attached to the tool 1001. FIG. 12C is a perspective view showing the joint bodies 105 and the tool 1001 in a state where the tool 1001 is transparent for showing an ejection port surface in the print element substrate 208. After the plurality of joint bodies 105 are arranged in array on the tool 1001 with high accuracy, the joint bodies 105 are jointed through the adhesive to the support member 108 fixed to another tool (not shown) to have high accuracy in relation to the reference in the Z direction. In the present embodiment, the joint bodies 105 installed in the tool 1001 are attached together to the support member 108.

Figure 12D:
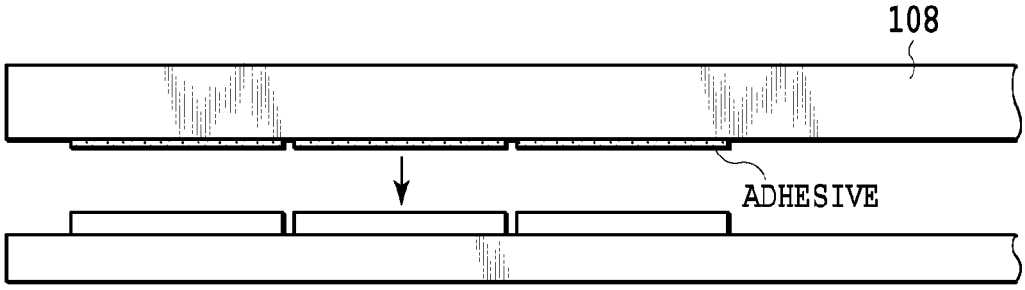

FIG. 12D is side view showing the tool 1001, the joint bodies 105, and the support member 108 at the time of moving the support member 108 to be close to the tool 1001 in which the joint bodies 105 are installed and causing the joint bodies 105 to abut against the support member 108. By attaching the joint bodies 105 to the support member 108 together in this way, the attachment of the joint bodies 105 to the support member 108 and the application and solidification of the adhesive can be performed one time. As a result, the productivity can be improved. At this time, the adhesive is in advance applied on all the joint positions of the support member 108 to the joint bodies 105, and thereafter, the joint bodies 105 abut against the support member 108 together, thus performing the attachment between the joint bodies 105 and the support member 108. At this time, the adhesive is applied on the support member 108 on some degree of thickness, and thereby the warpage and the roll of the support member 108 can be absorbed by the adhesive layer.

In the present embodiment, the joint bodies 105 are attached to the tool 1001, and these are jointed to the support member 108 together. Therefore accuracy of the surface in the Z direction between the joint bodies 105 is required to be high with each other. Accordingly the high accuracy is required to the tool 1001 to which the joint bodies 105 are attached.

It should be noted that in the present embodiment, at the time of lining up the joint bodies 105 on the tool 1001, the joint bodies 105 are suctioned and fixed on the tool 1001 with the surface of the joint body 105 to which the print element substrate 208 is attached being directed upward, but the present invention is not limited thereto, and the joint body 105 may be attached to the support member 108 with the surface of the joint body 105 to which the print element substrate 208 is attached being directed upward.

Fourth Embodiment

Next, an explanation will be made of a print head as a liquid ejection head according to a fourth embodiment of the present invention. It should be noted that components identical to those in the first embodiment to the third embodiment are referred to as identical signs to omit the explanation, and only different components will be explained.

Figure 13A:
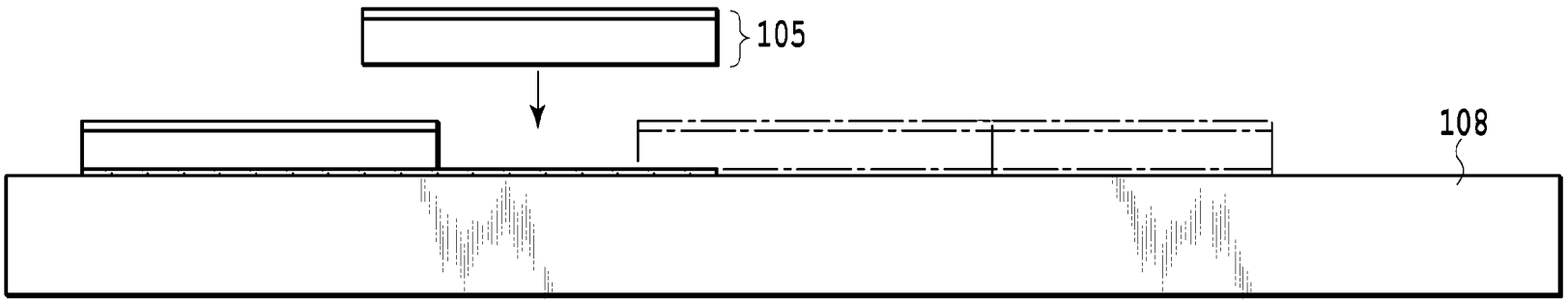
FIG. 13A is a side view showing a print head according to a fourth embodiment of the present invention.
Figure 13B:
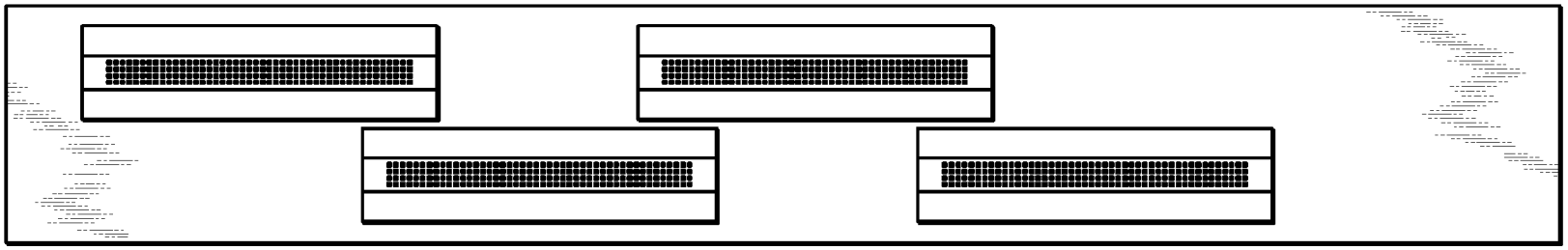
FIG. 13B is a plan view showing the print head according to the fourth embodiment.

FIGS. 13A and 13B are a side view and a plan view each showing a print head according to a fourth embodiment. FIG. 13A is a side view showing second joint bodies 105 and the support member 108 at the time the second joint body 105 in which the print element substrate 208 and the first member 103 are jointed is attached to the support member 108. FIG. 13B is a plan view showing the support member 108 to which the second joint bodies 105 are attached.

In the fourth embodiment, the joint bodies 105 in each of which the print element substrate 208 and the first member 103 are attached are arranged in array on the support member 108 in a zigzag manner. The attachment between the print element substrate 208 and the first member 103 in the joint body 105 and the attachment of the joint body 105 to the support member 108 are the same as those in the second embodiment and the third embodiment.

Even if the lining of the joint bodies 105 to the support member 108 is made in this way, it is possible to perform the mount according to the method of each of the second embodiment and the third embodiment.

Other Embodiment

It should be noted that in the above-mentioned embodiment, the joint body in which the print element substrate and the support member are jointed is suctioned by the finger capable of suctioning the joint body, and the suctioned joint body is moved to the position corresponding to the support member to be attached to the support member. However, in the attachment of the joint body to the support member in the present invention, the holding means for holding the joint body is not limited to the form of holding the joint body with the suction. The means of holding the joint body may be the other form, such as gripping the joint body as long as the means can certainly hold the joint body for arranging the joint body on the support member with high accuracy.

In addition, in the present specification, "print" is used not only in a case of forming meaningful information such as characters, figures and the like, but regardless of being meaningful or meaningless. Further, "print" broadly expresses a case of forming mages, designs, patterns, and the like on a print medium or processing a print medium regardless of being as obvious as people can visually perceive it.

In addition, "printing apparatus" includes apparatuses having a printing function, such as printers, printer complexes, copiers, facsimile apparatuses, and manufacturing apparatuses for performing manufacture of articles using inkjet technologies.

In addition, "print medium" expresses not only paper used in general printing apparatuses, but also a wide variety of materials that can receive ink, such as clothes, plastic films, metallic plates, glass, ceramics, lumber, leathers and the like.

Further, "ink" (also referred to as "liquid") should be broadly interpreted similarly to the definition of the above "print". "Ink" expresses liquids that are applied on a print medium, and thereby can be used for formation of images, designs, patterns and the like, processing of print mediums, or treatment of ink (for example, solidification or insolubilization of coloring materials in ink applied on a print medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-004316, filed Jan. 14, 2014, and No. 2014-239168, filed Nov. 26, 2014, which are hereby incorporated by reference herein in their entirety.

What is claimed is:

1. A method for manufacturing a liquid ejection head that includes (i) an element substrate including a pressure chamber that can store liquid therein, an energy generating element that applies energy to the liquid stored in the pressure chamber, an ejection port that ejects the liquid to which the energy is applied by the energy generating element, and a supply port that supplies the liquid to the pressure chamber; (ii) a first member that supports the element substrate; and (iii) a second member that supports the first member, the method for manufacturing the liquid ejection head comprising:

an element substrate joining step of joining the element substrate to one side of the first member, whose area is greater than that of the element substrate; and a first member joining step of holding a holding area provided on the one side of the first member by a holding member and joining a back side of the first member opposite to the one side of the first member to the second member.

2. The method for manufacturing the liquid ejection head according to claim 1, wherein in the first member joining step, the first member to which the element substrate is joined is caused to abut against the second member on which an adhesive is applied in a state where the holding area is held, and adjustment of a position of the element substrate relative to the second member is performed in a state in which the first member to which the element substrate is joined abuts against the second member through the adhesive.

3. The method for manufacturing the liquid ejection head according to claim 2, wherein an alignment mark is formed on the element substrate to recognize a position of the element substrate, and in the first member joining step, the adjustment of the position of the element substrate relative to the second member is performed while detecting the alignment mark.

4. The method for manufacturing the liquid ejection head according to claim 1, wherein in the first member joining step, the holding area is suctioned by a suction unit to hold the first member, to which the element substrate is attached.

5. The method for manufacturing the liquid ejection head according to claim 1, wherein in the element substrate joining step, each of a plurality of element substrates is joined to one of a plurality of first members, and in the first member joining step, the plurality of first members, to each of which one of the element substrates is joined, is caused to abut against the second member to join the plurality of element substrates and the plurality of first members to the second member.

6. The method for manufacturing the liquid ejection head according to claim 5, wherein in the first member joining step, the plurality of element substrates and the plurality of first members are together joined to the second member.

* * * * *